United States Patent [19]

Burgess et al.

[11] Patent Number: 4,526,585

[45] Date of Patent: Jul. 2, 1985

[54] BENEFICIATED COAL, COAL MIXTURES AND PROCESSES FOR THE PRODUCTION THEREOF

[75] Inventors: Lester E. Burgess; Karl M. Fox, both of Swarthmore; Phillip E. McGarry, Palmerton, all of Pa.

[73] Assignee: The Standard Oil Company, Cleveland, Ohio

[21] Appl. No.: 516,448

[22] Filed: Jul. 22, 1983

Related U.S. Application Data

[60] Division of Ser. No. 267,773, May 28, 1981, Pat. No. 4,412,843, which is a continuation-in-part of Ser. No. 114,414, Jan. 22, 1980, Pat. No. 4,304,573.

[51] Int. Cl.[3] ..... C10L 1/32

[52] U.S. Cl. ..... 44/51; 44/1 R

[58] Field of Search ..... 44/51, 1 R

[56] References Cited

U.S. PATENT DOCUMENTS

| | | |
|---|---|---|
| 1,390,230 | 9/1921 | Bates . |
| 2,397,859 | 4/1946 | Hersberger et al. . |
| 2,416,066 | 2/1947 | Phelps . |
| 2,671,758 | 3/1954 | Vinograd et al. . |
| 2,684,338 | 7/1954 | McGowan et al. . |
| 2,983,377 | 5/1961 | Singleton . |
| 3,015,396 | 1/1962 | Quast . |
| 3,244,615 | 4/1966 | Huntington . |
| 3,326,373 | 6/1967 | Lang . |
| 3,376,168 | 4/1968 | Horowitz . |
| 3,400,818 | 9/1968 | Tarjan . |
| 3,401,049 | 10/1968 | Horowitz . |
| 3,617,095 | 10/1967 | Kenneth . |
| 3,698,931 | 10/1972 | Horowitz . |
| 3,703,481 | 11/1972 | Barker et al. . |
| 3,732,084 | 5/1973 | Nixon et al. . |
| 3,762,887 | 10/1973 | Clancey et al. . |
| 3,880,580 | 4/1975 | Horowitz et al. . |
| 4,033,852 | 7/1977 | Horowitz et al. . |
| 4,101,293 | 7/1978 | Krause et al. . |
| 4,158,548 | 6/1979 | Burk et al. . |
| 4,163,644 | 8/1979 | Bowers . |
| 4,201,552 | 5/1980 | Rowell . |
| 4,217,109 | 8/1980 | Siwerson et al. . |
| 4,227,994 | 12/1980 | Knebel et al. . |
| 4,244,699 | 1/1981 | Smith et al. . |
| 4,248,698 | 2/1981 | Keller . |
| 4,249,699 | 2/1981 | Smith et al. . |
| 4,251,229 | 2/1981 | Joyo et al. . |
| 4,252,540 | 2/1981 | Yamamura et al. . |
| 4,252,639 | 2/1981 | Smith et al. . |
| 4,253,944 | 3/1981 | Hefner . |
| 4,255,155 | 3/1981 | Frankovich . |
| 4,255,156 | 3/1981 | Sun et al. . |
| 4,263,123 | 4/1981 | Ebert et al. . |
| 4,306,883 | 12/1981 | Eckman ..... 44/68 |

FOREIGN PATENT DOCUMENTS

| | | |
|---|---|---|
| 74582 | 2/1949 | Norway . |
| 1523193 | of 0000 | United Kingdom . |

OTHER PUBLICATIONS

Fuel Extension by Dispersion of Clean Coal in Oil—Government Report #FE-2694.

Feasibility Study of Molecular Grafting to Solubilize Coal—Government Report #FE-2020-1.

Cleaning of Eastern Bituminous Coal by the Grinding Froth Flotation and High Gradient Magnetic Separation.

Encyclopedia of Chemical Technology, Kirk-Othmer (1980), vol. 11, pp. 410-422 and pp. 449-473.

Encyclopedia Chemical Technology, Kirk-Othmer (1979), vol. 6, pp. 314-322.

*Primary Examiner*—Jacqueline V. Howard

*Attorney, Agent, or Firm*—Bruce E. Harang; David J. Untener; Larry W. Evans

[57] ABSTRACT

A process for the production of beneficiated coal and coal slurries having low ash, and sulfur involving admixing coal in an aqueous medium with a surface treating admixture comprising a polymerizable monomer, polymerization catalyst and a liquid organic carrier thereby rendering said coal highly hydrophobic and oleophilic. The resultant beneficiated coal product is formed into coal slurries, such as coal-oil mixtures.

7 Claims, 4 Drawing Figures

BENEFICIATED COAL, COAL MIXTURES AND PROCESSES FOR THE PRODUCTION THEREOF

CROSS-REFERENCE TO RELATED APPLICATION

This is a division of application Ser. No. 267,773, filed on May 28, 1981, now U.S. Pat. No. 4,412,843, which application is a continuation-in-part of copending U.S. application Ser. No. 114,414, filed Jan. 22, 1980, now U.S. Pat. No. 4,304,573 incorporated by reference herein.

BACKGROUND OF THE INVENTION

This invention relates to the beneficiation of coal and more particularly to an improved process for the beneficiation of coal and the formation of stable beneficiated coal mixtures, such as coal oil mixtures.

Known resources of coal and other solid carbonaceous fuel materials in the world are far greater than the known resources of petroleum and natural gas combined. Despite this enormous abundance of coal and related solid carbonaceous materials, reliance on these resources, particularly coal, as primary sources of energy, has been for the most part discouraged. The availability of cheaper, cleaner burning, more easily retrievable and transportable fuels, such as petroleum and natural gas, has in the past, cast coal to a largely supporting role in the energy field.

Current world events, however, have forced a new awareness of global energy requirements and of the availability of those resources which will adequately meet these needs. The realization that reserves of petroleum and natural gas are being rapidly depleted in conjunction with skyrocketing petroleum and natural gas prices and the unrest in the regions of the world which contain the largest quantities of these resources, has sparked a new interest in the utilization of solid carbonaceous materials, particularly coal, as primary energy sources.

As a result, enormous efforts are being extended to make coal and related solid carbonaceous materials equivalent or better sources of energy, than petroleum or natural gas. In the case of coal, for example, much of this effort is directed to overcoming the environmental problems associated with its production, transportation and combustion. For example, health and safety hazards associated with coal mining have been significantly reduced with the onset of new legislation governing coal mining. Furthermore, numerous techniques have been explored and developed to make coal cleaner burning, more suitable for burning and more readily transportable.

Gasification and liquefaction of coal are two such known techniques. Detailed descriptions of various coal gasifaction and liquefaction processes may be found, for example, in the *Encyclopedia of Chemical Technology,* Kirk-Othmer, Third Edition (1980) Volumne 11, pages 410–422 and 449–473. Typically, these techniques, however, require high energy input, as well as the utilization of high temperature and high pressure equipment, thereby reducing their widespread feasibility and value.

Processes to make coal more readily liquefiable have also been developed. One such process is disclosed in U.S. Pat. No. 4,033,852 (Horowitz, et al.). This process involves chemically modifying a portion of the surface of the coal in a solvent media, the effect of which renders the coal more readily liquefiable in a solvent than natural forms of coal, thereby permitting recovery of a liquefiable viscous product by extraction.

In addition to gasification and liquefaction, other methods for converting coal to more convenient forms for burning and transporting are also known. For example, the preparation of coal-oil and coal-aqueous mixtures are described in the literature. Such liquid coal mixtures offer considerable advantages. In addition to being more readily transportable than dry solid coal, they are more easily storable, and less subject to the risks of explosion by spontaneous ignition. Moreover, providing coal in a fluid form makes it feasible for burning in conventional apparatus used for burning fuel oil. Such a capability can greatly facilitate the transition from fuel oil to coal as a primary energy source. Typical coal-oil and coal-aqueous mixtures and their preparation are disclosed in U.S. Pat. Nos. 3,762,887, 3,617,095, 4,217,109, 4,101,293 and British Pat. No. 1,523,193.

Regardless, however, of the form in which the coal is ultimately employed, the coal or coal combustion products must be cleaned because they contain substantial amounts of sulfur, nitrogen compounds and mineral matter, including significant quantities of metal impurities. During combustion these materials enter the environment as sulfur dioxides, nitrogen oxides and compounds of metal impurities. If coal is to be accepted as a primary energy source, it must be cleaned to prevent pollution of the environment either by cleaning the combustion products of the coal or the coal prior to burning.

Accordingly, physical as well as chemical coal cleaning (beneficiation) processes have been explored. In general, physical coal cleaning processes involve pulverizing the coal to release the impurities, wherein the fineness of the coal generally governs the degree to which the impurities are released. However, because the costs of preparing the coal rise exponentially with the amount of fines to be treated, there is an economic optimum in size reduction. Moreover, grinding coal even to extremely fine sizes may not be effective in removing all the impurities. Based on the physical properties that effect the separation of the coal from the impurities, physical coal cleaning methods are generally divided into four categories: gravity, flotation, magnetic and electrical methods. In contrast to physical coal cleaning, chemical coal cleaning techniques are in a very early stage of development. Known chemical coal cleaning techniques include, for example, oxidative desulfurization of coal (sulfur is converted to a water-soluble form by air oxidation), salt leaching (oxidation of pyritic sulfur with ferric sulfate), and hydrogen peroxide-sulfuric acid leaching. Other methods are also disclosed in the above-noted reference to the *Encyclopedia of Chemical Technology,* Volume 6, pages 314–322.

While it is obvious from the foregoing that enormous efforts have been made to make coal a more utilizable source of energy, further work and improvements are still necessary and desirable before coal, coal mixtures and other solid carbonaceous fuel sources are accepted on a wide scale as primary sources of energy.

SUMMARY OF THE INVENTION

Accordingly, it is one object of the present invention to provide a unique and improved process for beneficiating coal.

Another object of this invention is to provide a uniquely beneficiated coal product.

Still another object of the present invention is to provide beneficiated coal which is very low in ash, sulfur and moisture content.

A still further object of the present invention is to provide a beneficiated solid particulate coal product which is cleaner and more suitable for combustion than heretofore processed coal.

A further object of this invention is to provide a beneficiated coal product without the utilization of burdensome and expensive solvent extraction methods.

Another object of this invention is to provide a beneficiated coal product which is highly suitable for forming coal slurries, such as coal-oil mixtures.

A still further object of the present invention is to provide a novel process for the formation of stable coal-oil mixtures.

A further object of the present invention is to provide beneficiated, stable coal slurries, such as coal-oil mixtures.

Still another object of this invention is to provide coal slurries or mixtures which are readily storable, transportable and burnable.

These and other objects are accomplished herein by a process which comprises contacting coal in an aqueous medium with a surface treating mixture comprising a polymerizable monomer, a polymerization catalyst and a liquid organic carrier, thereby providing a hydrophobic and oleophilic coal product adapted to the removal of further ash and sulfur by water separation techniques. The resultant product is highly suitable for the formation of beneficiated coal slurries and/or cleaned particulate coal.

DETAILED DESCRIPTION OF THE INVENTION

Figure 1:
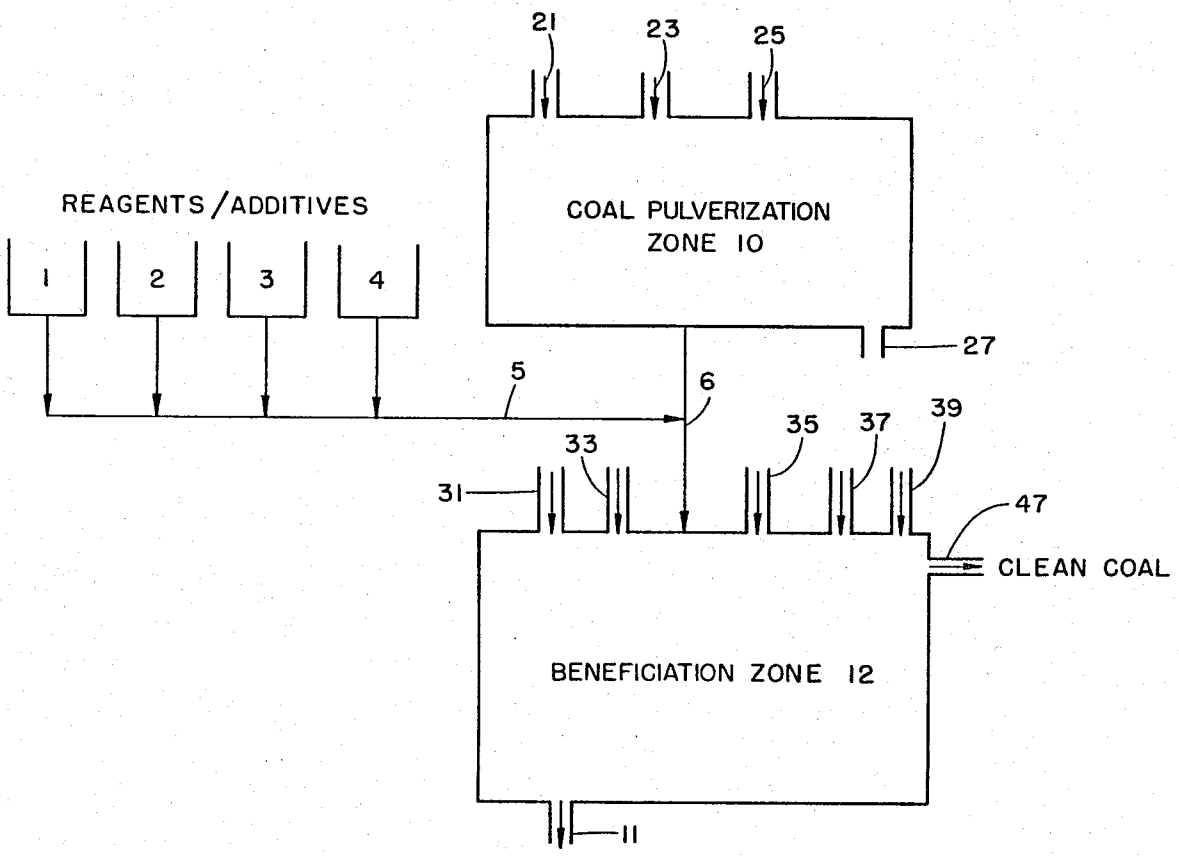
FIG. 1 is a flow diagram illustrating the process of the present invention whereby solid carbonaceous material, such as coal, is beneficiated.

In accordance with the present invention, a highly beneficiated coal product is produced by a process which involves surface treating particles of coal in an aqueous medium with a surface treating admixture comprising a polymerizable monomer, a polymerization catalyst and a liquid organic carrier, thereby rendering said coal particles hydrophobic and oleophilic. Thus, the process of this invention provides a highly beneficiated coal product of relatively low water content which can be even further dehydrated (dried) to a remarkable degree without the use of thermal energy. The ash content of the coal prepared by the present process is reduced to low levels and mineral sulfur compounds present are also removed. Moreover, the final coal product has enhanced BTU content and can be burned as a solid or combined with fuel oil or water to produce highly desirable beneficiated coal mixtures or slurries which are readily transportable and cleanly burned.

As used herein, the term "beneficiation" is intended to include methods for cleaning or otherwise removing impurities from a substrate, such as coal and to the recovery of coal from coal streams, such as, for example, the recovery of coal from waste streams in coal processing operations and the concentration or dewatering of coal streams or slurries such as, for example, by the removal of water in, for example, coal slurry pipelines.

In one embodiment for carrying out the present invention, wherein raw mined coal is employed as the feedstock, it is initially preferred to reduce raw mined coal or other solid carbonaceous material to a fine diameter size and to remove unwanted rock, heavy ash and the like materials collected in the mining operation. Thus, the coal is pulverized and initially cleaned, usually in the presence of water, wherein the coal is suspended and/or sufficiently wetted to permit fluid flow. The coal is pulverized employing conventional equipment such as, for example, ball or rod mills, breakers and the like.

It is generally desirable, although not necessary to the present process, to employ certain water conditioning (treating) additives in the pulverization operation. Such additives assist in rendering the ash more hydrophilic, which facilitates the separation thereof, in a manner that will be discussed hereinafter. Typical additives which are useful for purposes of this invention include conventional inorganic and organic dispersants, surfactants, and/or wetting agents. Preferred additives for this purpose include sodium carbonate, sodium pyrophosphate, and the like.

The coal-aqueous slurry formed in the pulverization operation is typically one having a coal to water ratio of from about 0.5:1 to about 1:5 and preferably about 1:3 parts by weight, respectively. If utilized, the water treating additives, hereinbefore described, are employed in small amounts, usually, for example, from about 0.25 to about 5%, based on the weight of dry coal. While it is generally recognized that more impurities are liberated as the size of the coal is reduced, the law of diminishing returns applies in that there is an economic optimum which governs the degree of pulverization. In any event, for the purposes of this invention, it is generally desirable to crush the coal to a particle size of from about 48 to about less than 325 mesh, preferably about 80% of the particles being of about a 200 mesh size (Tyler Standard Screen Size).

Any type coal can be employed in the process of the present invention. Typically, these include, for example, bituminous coal, sub-bituminous coal, anthracite, lignite and the like. Other solid carbonaceous fuel materials, such as oil shale, tar sands, coke, graphite, mine tailings, coal from refuse piles, coal processing fines, coal fines from mine ponds or tailings, carbonaceous fecal matter and the like are also contemplated for treatment by the process herein. Thus, for the purposes of this invention, the term "coal" is also intended to include these kinds of other solid carbonaceous fuel materials or streams.

In carrying out the beneficiation process herein, the coal-aqueous slurry, containing the pulverized coal, is contacted and admixed with a surface treating mixture comprised of a polymerizable monomer, polymerization catalyst and a small amount of a liquid organic carrier, such as fuel oil.

Any polymerizable monomer can be employed in the surface treating polymerization reaction medium. While it is more convenient to utilize monomers which are liquid at ambient temperature and pressure, gaseous monomers which contain olefinic unsaturation permitting polymerization with the same or different molecules can also be used. Thus, monomers intended to be employed herein may be characterized by the formula XHC=CHX' wherein X and X' each may be hydrogen or any of a wide variety of organic radicals or inorganic substituents. Illustratively, such monomers include ethylene, propylene, butylene, tetrapropylene, isoprene, butadiene, such as 1,4-butadiene, pentadiene, dicyclopentadiene, octadiene, olefinic petroleum fractions, styrene, vinyltoluene, vinylchloride, acrylonitrile, methacrylonitrile, acrylamide, methacrylamide, N-methylolacrylamide, acrolein, maleic acid, maleic anhydride, fumaric acid, abietic acid and the like.

A preferred class of monomers for the purposes of the present invention are unsaturated carboxylic acids, esters, anhydrides or salts thereof, particularly those included within the formula $$RC(=O)-OR'$$

wherein R is an olefinically unsaturated organic radical, preferably containing from about 2 to about 30 carbon atoms, and R' is hydrogen, a salt-forming cation such as alkali metal, alkaline earth metal or ammonium cation, or a saturated or ethylenically unsaturated hydrocarbyl radical, preferably containing from 1 to about 30 carbon atoms, either unsubstituted or substituted with one or more halogen atoms, carboxylic acid groups and/or hydroxyl groups in which the hydroxyl hydrogens may be replaced with saturated and/or unsaturated acyl groups, the latter preferably containing from about 8 to about 30 carbon atoms. Specific monomers conforming to the foregoing structural formula include unsaturated fatty acids such as oleic acid, linoleic acid, linolenic, ricinoleic, mono-, di- and tri-glycerides, and other esters of unsaturated fatty acids, acrylic acid, methacrylic acid, methylacrylate, ethyacrylate, ethylhexylacrylate, tertiarybutylacrylate, oleylacrylate, methylmethacrylate, oleylmethacrylate, stearylacrylate, stearylmethacrylate, laurylmethacrylate, vinylacetate, vinylstearate, vinylmyristate, vinyllaurate, unsaturated vegetable seed oil, soybean oil, rosin acids, dehydrated castor oil, linseed oil, olive oil, peanut oil, tall oil, corn oil and the like. For the purposes of this invention, tall oil and corn oil have been found to provide particularly advantageous results. Corn oil is especially preferred. Moreover, it is to be clearly understood that compositions containing compounds within the foregoing formula and in addition containing, for example, saturated fatty acids such as palmitic, stearic, etc. are also contemplated herein. Also contemplated herein as monomers are aliphatic and/or polymeric petroleum materials.

The amount of polymerizable monomer will vary depending upon the degree of surface treatment desired. In general, however, monomer amounts of from about 0.005 to about 0.1%, by weight, of the dry coal are used.

The catalysts employed in the coal surface treating beneficiation reaction of the present invention are any such materials commonly used in polymerization reactions. These include, for example, anionic, cationic or free radical catalysts. Free radical catalysts or catalyst systems (also referred to as addition polymerization catalysts, vinyl polymerization catalysts or polymerization initiators) are preferred herein. Thus, illustratively, free radical catalysts contemplated herein include, for example, inorganic and organic peroxides such as benzoyl peroxide, methylethyl ketone peroxide, tert-butylhydroperoxide, hydrogen peroxide, ammonium persulfate, di-tertbutylperoxide, tert-butyl-perbenzoate, peracetic acid and including such non-peroxy free-radical initiators as the diazo compounds such as 1,1'-bisazoisobutyronitrile and the like.

Typically, for the purposes of this invention, any catalytic amount (e.g. 1 pound per ton of dry coal feed) of the foregoing described catalysts can be used.

Moreover, free radical polymerization systems commonly employ free radical initiators which function to help initiate the free radical reaction. For the purposes herein, any of those disclosed in the prior art, such as those disclosed, for example, in U.S. Pat. No. 4,033,852, incorporated by reference herein, may be used. Specifically, some of these initiators include, for example, water soluble salts, such as sodium perchlorate and perborate, sodium persulfate, potassium persulfate, ammonium persulfate, silver nitrate, water soluble salts of noble metals such as platinum and gold, sulfites, nitrites and other compounds containing the like oxidizing anions, and water soluble salts of iron, nickel chromium, copper, mercury, aluminum, cobalt, manganese, zinc, arsenic, antimony, tin, cadmium, and the like. Particularly preferred initiators herein are the water soluble copper salts, i.e. cuprous and cupric salts, such as copper acetate, copper sulfate and copper nitrate. Most advantageous results have been obtained herein with cupric nitrate, $Cu(NO_3)_2$. Further initiators contemplated herein are disclosed in copending U.S. patent application Ser. No. 230,063 filed Jan. 29, 1981 incorporated herein by reference. Among others, these initiators include metal salts of organic moities, typically metal salts of organic acids or compositions containing organic acids, such as naphthenates, tallates, octanoates, etc. and other organic soluble metal salts, said metals including copper, chromium, mercury, aluminum, antimony, arsenic, cobalt, manganese, nickel, tin, lead, zinc, rare earths, mixed rare earths, and mixtures thereof and double salts of such metals. The combination of copper and cobalt salts, particularly cupric nitrate and cobalt naphthenate, have been found to provide particularly good and synergistic results.

The amounts of free radical initiator contemplated herein are any catalytic amount and generally are within the range of from about 10–1000 ppm (parts per million) of the metal portion of the initiator, preferably 10–200 ppm, based on the amount of dry coal.

The surface treating reaction mixture of the present invention also includes a liquid organic carrier. This liquid organic carrier is utilized to facilitate contact of the surface of the coal particles with the polymerization reaction medium. Thus, liquid organic carriers included within the scope of this invention are, for example, fuel oil, such as No. 2 or No. 6 fuel oils, other hydrocarbons including benzene, toluene, xylene, hydrocarbons fractions, such as naphtha and medium boiling petroleum fractions (boiling point 100°–180° C.); dimethylformamide, tetrahydrofuran, tetrahydrofurfuryl alcohol, dimethylsulfoxide, methanol, ethanol, isopropyl alcohol, acetone, methylethyl ketone, ethyl acetate and the like and mixtures thereof. For the purposes of this invention, fuel oil is a preferred carrier.

The amounts of liquid organic carrier, such as fuel oil, utilized in the surface treatment reaction herein are generally in the range of from about 0.25 to about 5% by weight, based on the weight of dry coal.

The surface treatment reaction of the present process is carried out in an aqueous medium. The amount of water employed for this purpose is generally from about 65% to about 95%, by weight, based on the weight of coal slurry.

The surface treating reaction conditions will, of course, vary, depending upon the specific reactants employed and results desired. Generally, however, any polymerization conditions which result in the formation of a hydrophobic or oleophilic surface on the coal can be utilized. More specifically, typical reaction conditions include, for example, temperatures in the range of from about 10° C. to about 90° C., atmospheric to nearly atmospheric pressure conditions and a contact time, i.e. reaction time, of from about 1 second to about 30 minutes, preferably from about 1 second to about 3 minutes. Preferably, the surface treatment reaction is carried out at a temperature of from about 15° C. to about 80° C. and atmospheric pressure for about 2 minutes. In general, however, the longer the reaction time, the more enhanced are the results.

In the practice of the present invention, the coal can be contacted with the surface treating ingredients by employing various techniques. For example, one technique is to feed the aqueous pulverized coal slurry through a spraying means, e.g. nozzle, and add the surface treating ingredients, i.e. polymerizable monomer, polymerization catalyst, initiator and liquid organic carrier to the aqueous coal spray. The resultant total spray mixture is then introduced to an aqueous medium contained in a beneficiation vessel. In a preferred embodiment when this technique is used, the surface treated aqueous coal mixture now in the vessel is recycled to the same vessel by re-feeding the mixture to the vessel through at least one of said spraying means.

In a second technique, the aqueous coal slurry and surface treating ingredients, i.e. polymerizable monomer, polymerization catalyst, initiator and liquid organic carrier, are admixed in a premix tank and the resultant admixture is sprayed, e.g. through a nozzle, into an aqueous medium contained in a beneficiation vessel. In another and third technique, the resultant surface treated aqueous coal mixture, formed in the beneficiation vessel in accordance with the foregoing described second technique, is recycled to the same vessel by re-feeding the mixture to the vessel through at least one of said spraying means.

As the surface treating reaction is completed, the hydrophobic and oleophilic beneficiated coal particles float to the surface of the liquid mass. The ash, still remaining hydrophilic, tends to settle and is removed to the water phase. Thus, the coal which results from reaction with the hereinbefore described polymerizable surface treating mixture is extremely hydrophobic and oleophilic and consequently readily floats and separates from the aqueous phase, providing a ready water washing and for high recoveries of coal. The floating hydrophobic coal is also readily seperable from the aqueous phase (for example, a skimming screen may be used for the separation), which contains ash, sulfur and other impurities which have been removed from the coal. While it is not completely understood and while not wishing to be bound to any theory, it is believed that the surface treatment polymerization reaction involves the formation of a polymeric organic coating on the surface of the coal by molecular grafting of polymeric side chains on the coal molecules.

In the practice of the present invention, the surface treated coal is preferably subjected to at least one further wash step wherein the coal phase or phases are redispersed, with good agitation, e.g. employing high speed mixers, as a slurry in fresh wash water. Preferably, the initially surface treated coal is added to the wash water under atomizing pressure through a spray nozzle thus forming minute droplets in air which are directed with force onto and into the surface of the fresh water mass.

By spraying, the wash water and the coal phase are intimately admixed under high speed agitation and/or shear produced by the spray nozzle under super atmospheric pressures. In this manner, the hydrophobic coal particles are jetted into intimate contact with the wash water through one or more orifices of the spray nozzle thereby inducing air inclusion, both in the passage through the nozzle as well as upon impingement upon and into the air-water interface of the wash water bath.

U.S. Ser. No. 230,058 and U.S. Ser. No. 230,059 both filed on Jan. 29, 1981, both incorporated by reference herein, describe and claim a particularly effective method and apparatus for separating the treated coal particles from unwanted ash and sulfur in the water phase utilizing an aeration spray technique, wherein a coal froth phase is formed by spraying or injecting the treated coal-water slurry into the surface of the cleaning water. Briefly, according to the method and apparatus there described, the coal slurry is injected through at least one selected spray nozzle, preferably of the hollow cone type, at pressures, for example, at from about 15–20 psig, at a spaced-apart distance above the water surface, into the water surface producing aeration and a frothing or foaming of the coal particles, causing these particles to float to the water surface for skimming off.

The foregoing described washings may be carried out with the treated coal slurry in the presence of simply water at temperatues of, for example, about 10° to about 90° C., preferably about 30° C., employing from about 99 to about 65 weight percent water, based on the weight of dry coal feed. Alternatively, additional amounts of any or all of the heretofore described surface treating ingredients i.e. polymerizable monomer, catalyst, initiator, liquid organic carrier, may also be added to the wash water. Moreover, the washing conditions e.g. temperature, contact time, etc., utilized when these ingredients are employed can be the same as if only water is present or the washing conditions can be the same as those described heretofore with respect to surface treatment of the coal with the surface treating mixture. Of course, water conditioning additives may also be utilized during the washing steps, if desired.

After washing and/or additional surface treatment, the beneficiated coal may be dried to low water levels simply by mechanical means, such as by centrifugation, pressure or vacuum filtration etc., thus avoiding the necessity for costly thermal energy to remove residual water. The beneficiated coal prepared by the process of this invention, as hereinbefore described, generally contains from about 0.5% to about 10.0% by weight ash, based on the weight of dry coal. Moreover, the sulfur content is from about 0.1% to about 4% by weight, preferably about 0.3 to about 2%, based on the weight of dry coal and the water content is from about 2% to about 25%, preferably from about 2% to about 15%, by weight, based on the weight of dry coal.

At this point, the beneficiated coal can be used as a high energy content, ash and sulfur reduced, fuel product. This beneficiated fuel product can be utilized in a direct firing burner apparatus. Alternatively, the beneficiated particulate coal can be blended with a carrier such as oil to provide a highly stable and beneficiated coal slurry, such as a coal-oil mixture (COM). Oil, preferably fuel oil, such as No. 2, or No. 6, is blended with the beneficiated coal at any desired ratio. These ratios typically include from about 0.5 to about 1.5 parts by weight coal to 1 part oil. Preferably a 1:1 weight ratio is employed.

It is also to be understood herein that the solid beneficiated coal product of the present invention can also be redispersed in aqueous systems for pumping through pipelines. If desired, to provide improved stability, selected metal ions, by way of their hydroxide or oxide, can be added to the aqueous dispersion to preferably adjust the pH of the slurry to above 7. Thus, for this purpose, alkali and/or alkaline earth metals, each as, sodium, potassium, calcium, magnesium, etc., hydroxide or oxides, can be used. Sodium hydroxide is preferred.

It has also been discovered herein that a stabilized coal-oil mixture can be provided by the presence therein of the alkali or alkaline earth metal, e.g. (sodium, potassium, calcium, magnesium, etc.) salt of a fatty acid of the formula $$R''\overset{\overset{\displaystyle O}{\|}}{C}-OH$$

wherein R'' is a saturated or an olefinically unsaturated organic radical. Thus, the hereinbefore described unsaturated fatty acids, i.e., $$R\overset{\overset{\displaystyle O}{\|}}{C}OR',$$

wherein R' is hydrogen and R is as defined before, are also intended for use herein. The presence of these fatty acid salts in the beneficiated coal-oil mixtures of this invention permits the ready dispersion of the coal in the fuel oil to produce a gel or other structure which retards settling almost indefinitely. Other metal ions, in addition to alkali or alkaline earth metals, are also useful to form stabilizing fatty acid salts. These other metals include, for example, iron, zinc, aluminum and the like.

Generally, the amount of fatty acid utilized in forming the stable coal-oil mixture will be from 3.0 to 0.5% by weight, based on the total weight of the mixture. The amount of alkali or alkaline earth containing compound utilized to form the gel will be sufficient to neutralize a substantial portion of the fatty acid and thus generally varies from about 0.1 to 1.0% and usually 0.1% to 0.6% by weight, based on the total weight of the coal-oil mixture. Preferably for a 50:50 coal-oil mixture, 1.5% by weight acid and 0.3% by weight of neutralizing compound are added to the mixture.

An alternative practice herein to form stable coal-oil mixtures is to subject the coal-oil mixture to an additional surface treating reaction where additional amounts of polymerizable monomer and polymerization catalyst are added to a mixture of the beneficiated coal in oil. In this case, the polymerizable monomer is again an unsaturated carboxylic acid as described above, preferably tall oil, used in amounts of 3.0 to 0.5% by weight, preferably 1.5%, based on the total weight of the mixture. The polymerization catalyst can be any of those described hereinbefore and is preferably cupric nitrate, used in amounts of 2.0 to 10 ppm (parts per million), preferably 5 ppm, based on the total weight of the mixture. The polymerizable monomer and polymerization catalyst are added to the coal-oil mixture with stirring. Thereafter, alkali or alkaline earth metal compound, such as sodium hydroxide, in an amount of 0.6 to 0.1%, by weight, preferably 0.3%, based on the total weight of the mixture is added to the mixture. The resulting product is a preferred stabilized coal-oil mixture.

Other processes which are suitable herein for preparing stable beneficiated coal-oil mixtures are disclosed and claimed in U.S. Ser. No. 230,055 and U.S. Ser. No. 230,064 both filed Jan. 29, 1981 and both incorporated herein by reference. More particularly, U.S. Ser. No. 230,055 discloses and claims a process for forming stable coal-oil mixtures by admixing beneficiated coal with a fatty acid ester, such as triglyceride, preferably tallow, and a base, such as sodium hydroxide. Briefly, U.S. Ser. No. 230,064 discloses and claims a process for forming stabilized coal-oil mixtures by initially admixing, under low shear conditions and at an elevated temperature, coal, oil, polymerizable monomer and polymerization catalyst, and immediately thereafter subjecting the mixture to a condition of high shear agitation at the same elevated temperature. The resultant coal-oil mixture is then treated with a gelling agent, such as a hydroxide, like sodium hydroxide, to form a stable beneficiated coal-oil mixture which is in the form of a gel or thixotropic mixture.

The coal fuel oil products, i.e. coal-oil mixtures, of the present invention have unique properties. For example, the present coal-oil mixtures are thixotropic, have increased energy content, can utilize coal having low ash, low sulfur and low moisture content and a wide variety of coals and can provide the potential for a widely expanded market for coal as a fluid fuel thereby assisting in the conservation of petroleum.

With specific reference to the drawings herein, and particularly to FIG. 1, the process of this invention is illustratively carried out, for example, by initially pulverizing raw mined coal in pulverization zone 10 in the presence of water, and if desired, water conditioning additives, to form an aqueous coal slurry. This aqueous coal slurry is mixed in line 6 with surface treating reagents and/or additives, fed to line 6 from tanks 1, 2, 3, and 4 via line 5, and the thusly treated coal-slurry is introduced to beneficiation zone 12, as shown. Tanks 1, 2, 3 and 4 contain, for example, polymerizable monomer, free radical catalyst, free radical initiator and liquid organic carrier, respectively. Raw mined coal is fed to zone 10 through line 23; water is fed through line 21 and water conditioning additives may be introduced via line 25. Unwanted materials, such as rock, are removed via line 27.

Water is generally the principal ingredient in beneficiation zone 12. Thus, the treated coal-slurry being fed to zone 12 via line 6 is now hydrophobic and oleophilic and after admixture with the wash water in zone 12, for example, by high speed mixer or spray atomizer, readily floats on the surface of the water, thereby forming a coal froth phase and an aqueous phase in zone 12. The coal froth phase in zone 12 is readily removed from zone 12 (for example, by skimming) through line 47 to provide a beneficiated, i.e. clean, coal product according to the present invention having a reduced ash, sulfur and water content. If desired, the clean coal from line 47 may be further dried to remove additional water. The aqueous phase, remaining in zone 12, contains ash, sulfur and other hydrophilic impurities and can be removed therefrom through line 11.

Alternatively, in carrying out the process of the present invention, in accordance with FIG. 1, the surface treating reagents and/or additives may be admixed with the aqueous coal slurry directly in beneficiation zone 12. Thus, these reagents and/or additives can be introduced to zone 12 via line 31 (monomer), 33 (free radical catalyst), 35 (free radical initiator) 37 (water), 39 (liquid organic carrier). The coal slurry is fed to zone 12 through line 6 and thusly admixed with the reagents in zone 12. In another manner, as described hereinbefore, the surface treating additives can be added to the coal spray coming from line 6.

Figure 2:
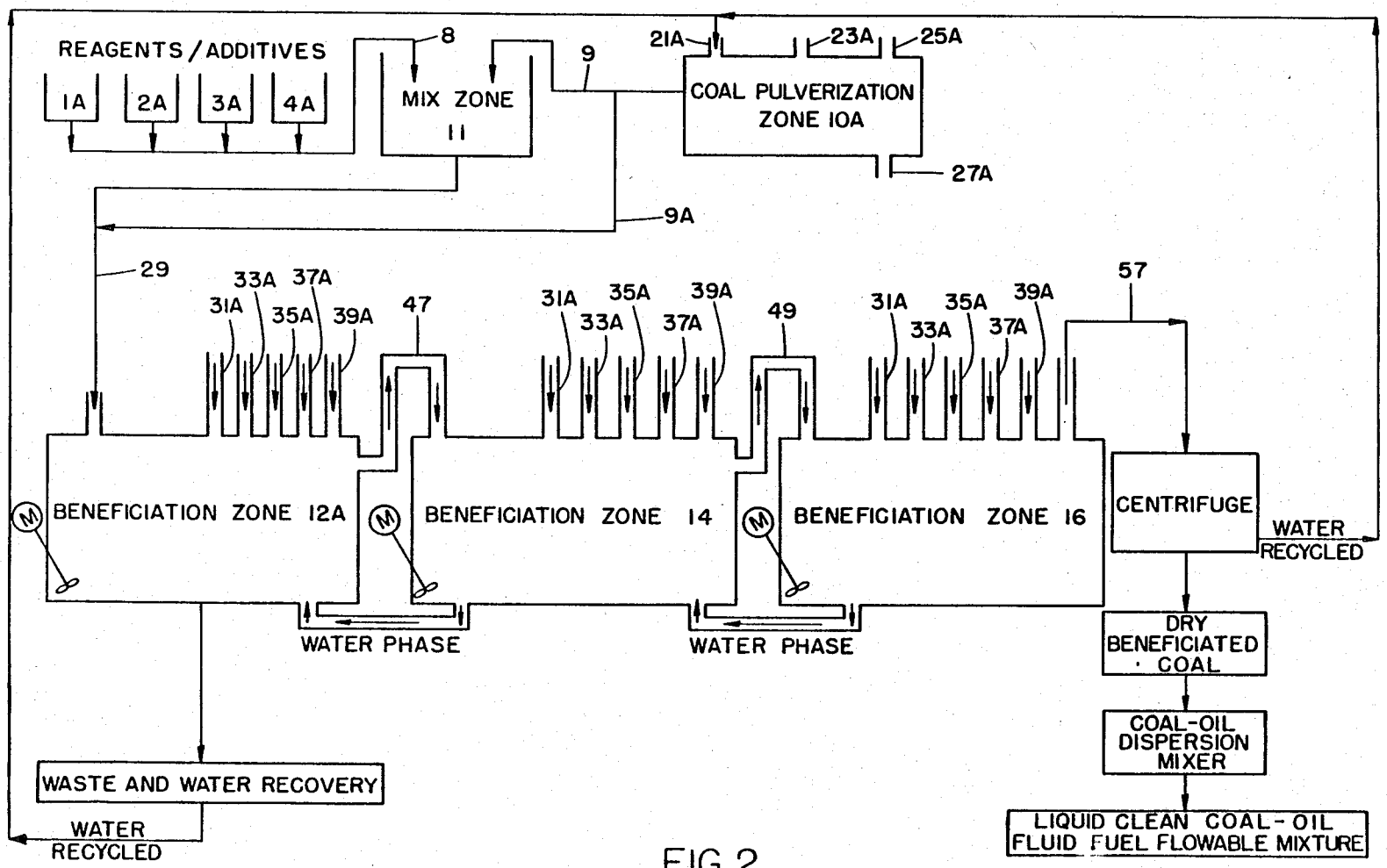
FIG. 2 is a flow diagram illustrating a preferred manner by which solid carbonaceous materials, such as coal, are beneficiated according to the present invention.

With specific reference to FIG. 2, the process of this invention is illustratively continuously carried out beginning with raw mined coal and ending with a coal-oil mixture, although as indicated above other feedstocks and products, such as beneficiated particulate coal and coal-water mixtures are also contemplated herein. Thus, referring to FIG. 2, raw coal is initially pulverized in pulverization zone 10A in the presence of water and, if desired, water conditioning additives, to form an aqueous coal slurry. This aqueous coal slurry is fed to mix zone 11, through line 9, and admixed in zone 11 with surface treating reagents/additives transported from reagent and/or additive tanks 1A, 2A and 3A and 4A, via line 8. Tanks 1A, 2A, 3A and 4A contain, for example, polymerizable monomer, free radical catalyst, free radical initiator and liquid organic carrier, respectively. Raw mined coal is fed to zone 10A through line 23A, water is fed through line 21A and water conditioning additives may be introduced to zone 10A via line 25A. The resultant admixture in mix zone 11 is then introduced to a first beneficiation zone 12A through line 29.

Alternatively, surface treating additives (or additional surface treating additives) i.e., polymerizable monomer, polymerization catalyst, liquid organic carrier, hereinbefore described, may be added directly to zone 12A (or zones 14 and 16), for example, through line 31A (monomer), 33A (free radical catalyst), 35A (free radical initiator), 37A(water), 39A (liquid organic carrier), or they can be admixed beforehand along with the pulverized coal slurry in lines leading to the beneficiation zones or vessels in the zones. In the case where the surface treating reagents/additives are added directly to zone 12A, the coal slurry from zone 10A may be added directly to zone 12A via lines 9A and 29. In addition, as described before, the coal slurry in the benefication vessel can be recycled within each particular vessel to achieve greater mixing and separation.

The coal in zone 12A is extremely hydrophobic and oleophilic and after good agitation with, for example, a high speed mixer or spray atomizer, a coal froth phase ensues which is recovered. A screen may be advantageously used for the separation and recovery of the flocculated coal. If desired, the recovered coal can be introduced, via lines 47 and 49 to a further sequence of wash steps, (e.g. zones 14 and 16) wherein with further agitation of the recovered hydrophobic coal froth from zone 12A, provided by high speed mixers, or other means, such as a spray atomizer, additional ash is removed to the water phase.

The water-wetted ash suspension phase, which is also formed in zone 12A, can be recovered and can be sent to waste and water recovery, after which the water can be recycled for reuse in the process as shown in FIG. 2.

Alternatively, as indicated above, additional ash and sulfur is removed from the beneficated coal froth phase by a series of counter-current water-wash steps, i.e. the water phase in the wash zones 14 and 16 can be recycled to a previous wash zone, as also ilustrated in FIG. 2. As indicated hereinbefore, in addition to water, zones 12A, 14 and 16 may also contain any or all of the foregoing chemical surface treatment additives. The finally washed and surface treated coal exiting zone 16 via line 57 can be dried to a very low water level by, for example, centrifugation. The water which is taken off in the centrifuge may also be recycled in the process as shown. The recovered dry beneficiated coal product can be used directly as such as a solid fuel or can be blended with a carrier to form a highly desirable beneficiated coal slurry, such as a coal-oil-liquid fuel mixture.

In the preparation of the coal-oil mixture, FIG. 2 illustrates that the dry beneficiated surface treated coal is fed to a coal-oil dispersion mixer, wherein, preferably hereinbefore identified $$R''\overset{\overset{\displaystyle O}{\|}}{C}-OH$$

acid, such as tall oil or naphthenic acid, may be added along with alkali metal hydroxide, such as sodium or calcium hydroxide, to form a stable dispersion. If desired, further surface treatment of the coal may be carried out in the coal-oil dispersion mixer by adding a polymerizable monomer and polymerization catalyst to the admixture, as described above, with or without subsequent addition of alkali or alkaline earth hydroxide. Illustratively, coal-fuel dispersion can be carried out, either continuously or batchwise, in, for example, conventional paint grinding equipment, wherein heavy, small grinding media are used to shear the dispersion into a non-settling flowable coal-fuel product of thixotropic nature.

It is to be understood herein that while the coal-oil admixture process illustrated herein utilizes coals beneficiated as described herein, any coal, e.g. raw coal, coal beneficiated by processes not herein described and the like, can also be employed to form stable coal-oil mixtures in accordance with the process of the present invention.

Figure 3:
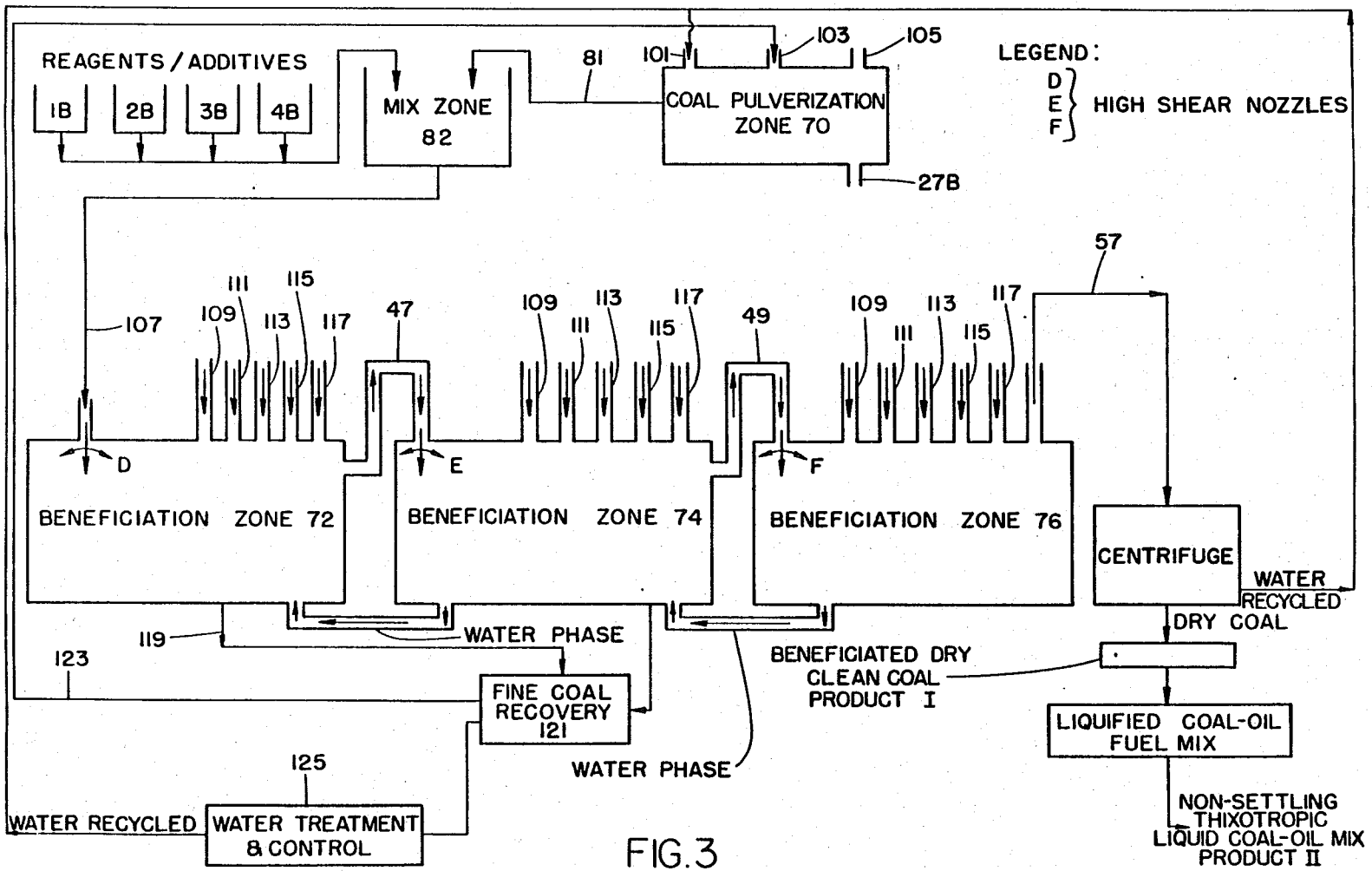
FIG. 3 is a further flow diagram depicting another preferred mode by which the present invention is performed.

FIG. 3 illustrates a further preferred mode by which the present invention may be performed. With specific reference thereto, raw mined coal is introduced to pulverization zone 70, through line 103 and pulverized therein in the presence of water which is added via line 101. The water preferably contains a conditioning or treating additive such as an inorganic or organic surfactant, wetting agent, dispersant or the like which enhances the effectiveness of the water. Typical organic surfactants (such as Triton X-100) include anionic, cationic and nonionic materials. Sodium pyrophosphate is a preferred additive for the purposes of this invention. Conditioning ingredients can be fed to zone 70 through line 105, for example. The aqueous coal slurry in zone 70 is sent to mix zone 82 via line 81 and admixed therein with reagents/additives from tanks 1B, 2B, 3B and 4B containing polymerizable monomer, free radical catalyst, free radical initiator and liquid organic carrier, respectively, for example.

The aqueous coal slurry admixture formed in zone 82 is fed to a first water wash zone 72 through line 107 and through high shear nozzle D, whereby the velocity of the stream and the shearing forces are believed to break up the coal phase stream into fine droplets which in turn can pass through an air interface within wash zone 72 and impinge downwardly upon and forcefully jet into the mass of the continuous water in, e.g. a tank or tanks, contained therein. If desired, further surface treating reagents, and/or additives, hereinbefore identified, may be added to zone 72, (and/or zones 74 and 76), for example, through lines 109 (polymerizable monomer), 111 (free radical catalyst), 113 (free radical initiator), 115 (water), 117 (liquid organic carrier). The hydrophobic and oleophilic coal phase, which ensues in zone 72, is then preferably, as shown, fed to a further sequence of wash zones, via line 47.

Without intending to be limited to any theory or reaction mechanism, it is believed to be helpful to discuss the phenomena thought to provide some of the advantageous results achieved by the process herein. Thus, the high shearing forces created in mixing, such as in nozzle D, are believed to assist in breaking up the coal-oil water flocs as the dispersed particles forcefully enter the surface of the water in the tank, thereby water-wetting and releasing ash and other impurities from the interstices between the coal flocs. The coal flocs are thereby broken up so that the trapped ash and other impurities are freed and introduced to the aqueous phase and thus separated from the coal particles. The finely divided coal particles, whose surfaces are now believed surrounded by polymer and liquid organic carrier, such as fuel oil, also now contain (occluded) air sorbed in the atomized particles as a result of the shearing effects of the nozzle. The combination of surface treatment and sorbed air causes the flocculated coal to decrease in apparent density and to float on the surface of the water, as a distinct coal froth phase. Thus, the coal particles assume a density less than water, repel water by virtue of their increased hydrophobicity and quickly float to the surface of the water.

By the foregoing technique, not only is ash substantially removed from the treated coal product, but the entrapped air and the more hydrophobic and oleophilic coal surfaces provide for a marked increase in the yield of total beneficiated treated coal, which is ultimately recovered.

The still hydrophilic ash remains in the bulk aqueous phase and tends to settle downward in the tank by gravity and is withdrawn from zone 72 in an ash-water stream 119 from the base of the vessel. Some small amount of fine coal which may not be separated completely can be transferred with the aqueous phase (withdrawn ash-water stream) to a fine coal recovery zone 121, as shown in FIG. 3. Recovered coal fines can be recycled via line 123 to the aqueous coal slurry in zone 70.

The wash process carried out in zone 72 can be repeated, employing a counter-current wash system, whereby the coal progresses to a cleaner state through sequential introduction to beneficiation zones 74 and 76, via lines 47 and 49, as illustrated in FIG. 3. Concomitantly, clean wash water becomes progressively loaded with water soluble and water wetted solid impurities extracted by the wash water.

As described before, the intimately admixed ash-water suspension coming from zone 72, containing some small amounts of particulate coal, is forwarded to fine coal recovery zone 121 where high ash-low water solids are recovered and expelled for removal from the process and the fine coal is recycled, as shown. The wash water can be further treated, at 125, to control the condition of the recovered water prior to recycle. The cleaned water is recycled to the original aqueous coal slurry or such other make-up as the overall process may require to balance material flow.

As shown in FIG. 3, the coal froth phases resulting in zones 72 and 74 can be introduced for further washings via nozzles E and F, respectively. In this manner, the coal particles are again atomized. The velocity and high shear created by nozzles E and F once again permit wash water contact with any ash still retained in the interstices of the coal flocs, thereby assisting, in each wash step, to release ash to the aqueous phase. The aqueous phases in zones 72, 74 and 76 float the flocculated coal-oil-air mass to the top of the respective tanks.

The final coal froth phase in zone 76 is fed to a centrifuge, via line 57, for drying. The beneficiated, clean coal phase is thereby remarkably dried without the necessity for thermal energy, which is believed due to the reduced attraction for water between the large coal-oil surfaces and the water physically occluded therebetween in the flocculated dry coal recovered from the mechanical drying step.

The dry hydrophobic cleaned coal can be used advantageously at this point as a higher energy content, ash and sulfur reduced solid fuel, which is referred to herein as Product I. This solid fuel can be utilized in direct firing or to form beneficiated coal slurries as described above.

As indicated above in another embodiment of this invention, a liquid fuel mixture, which is easily pumped as a liquid, but which is of such rheological quality as to form a thixotropic liquid, can also be provided. A thixotropic liquid is one that has "structure" or tends to become viscous and gel-like upon standing quiescently, but which loses viscosity and the "structure" or gel decreases markedly and rapidly upon subjecting the thixotropic liquid to shearing stresses, as by agitation through mixing and pumping processes or by heating.

In the practice of this invention, as illustrated by FIG. 3, the dry, beneficiated coal Product I is mixed with a quantity of fuel oil (illustratively 1:1 by weight and preferably heated to reduce viscosity especially in instances wherein the fuel oil is of a heavy viscosity grade) in a mix tank to provide a pumpable fluid mixture.

Alternatively, the fuel-oil coal mixture in the mix zone may be subjected to an additional surface treatment step, in line with the general reaction procedure employed in the initial surface treatment beneficiation, hereinbefore described. For this purpose, any of the hereinbefore identified polymerizable monomers, such as tall oil, corn oil, and the like may be used and added to the mix zone along with any of the hereinbefore identified polymerization catalysts and/or initiators. Moreover, the saturated carboxylic acids hereinbefore described may be used alone or in combination with the unsaturated acids, if desired. In the case wherein saturated acids are used alone, initiators and catalysts need not be employed. Naphthenic acids are illustrative of saturated acids which may be used.

The admixture of surface treated coal, fuel oil and carboxylic acid can then be substantially neutralized, with a water soluble alkali metal, such as from a hydroxide, like sodium hydroxide, calcium hydroxide or mixtures thereof as indicated above to form a stable coal-oil mixture. A liquid cleam coal-oil fuel mixture (Product II), having no flowable high energy source for a wide variety of end uses.

Alternatively, the beneficiated coal product I can be slurried with water to provide coal-aqueous slurries or mixtures.

Figure 4:
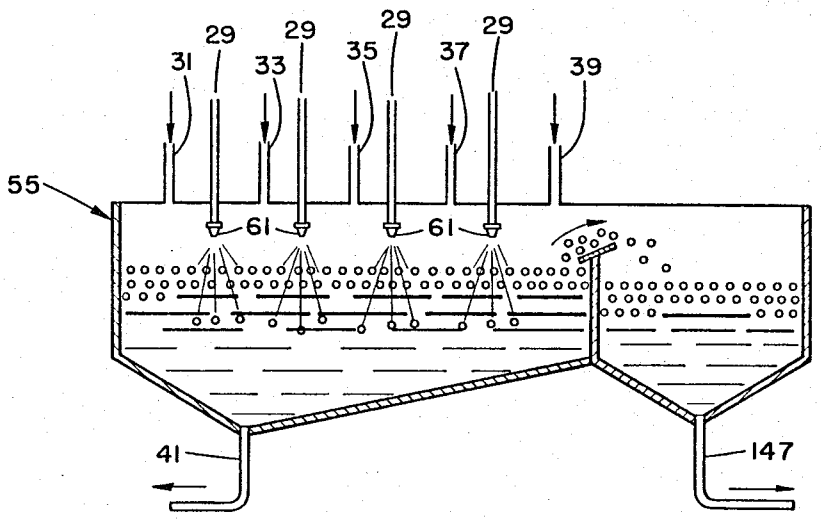
FIG. 4 is an illustration of a typical vessel which may be utilized in the practice of the present invention.

FIG. 4 illustrates a unit 55 which is suitable as a froth flotation vessel useful in any of the wash and/or beneficiation zones employed in the present process. In this unit, the aqueous coal slurry i.e. admixture of coal, water and preferably surface treating reagents/additives, is sprayed into the vessel through lines 29 and through spray nozzles 61. Additional surface treating reagents/additives or any other desired ingredients may also be added via lines 31, 33, 35, 37 and 39. In this vessel the coal froth is skimmed off from the main portion of the vessel into a collector compartment and can be introduced to the next zone via line 147, for example. The aqueous-ash phase in the main portion of the vessel is removed through line 41, for example.

It is to be understood herein that any of the zones illustrated in FIGS. 1-3 may comprise a single vessel or zone or any number of vessels or zones arranged in a manner suitable and in accordance with carrying out the invention as described herein.

In order that those skilled in the art may better understand how the present invention may be practiced, the following examples are given by way of illustration and not by way of limitation.

EXAMPLE 1

200 grams of Pittsburgh seam coal having an initial ash content of 6.2% and initial sulfur content of 1.5% is pulverized in the presence of 400 grams of water to a 200 mesh size using a ball mill grinding unit. The coal is transferred to a mixing vessel. Into this vessel containing the coal is also introduced 0.05 grams of corn oil, 2.0 grams of #2 fuel oil, 1.0 cc. of a 5.0% solution of hydrogen peroxide in water and 2.0 cc. of a cupric nitrate solution in water. The mixture is stirred and heated to about 30° C. for about 2 minutes. The resultant mixture is sprayed into a vessel containing clean water and a frothing ensues. The coal, in the coal froth phase, is skimmed from the water surface. The water phase containing large amounts of hydrophilic ash and sulfur is discarded.

The cleaning procedure is repeated two further times using clean water and skimming the frothed coal from the water surface. The particulate coal is then dried to a water content of 15%, based on the weight of dry coal, using a laboratory Buchner funnel. The ash content of the final particulate product is reduced to 1.5% and the sulfur content is reduced to 0.8%.

EXAMPLE 2

The procedure of Example 1 is repeated using equivalent amounts of (a) coker gasoline; (b) oleic acid; and (c) tall oil, each substituted for the corn oil. A cleaned coal particulate product is produced having an ash content of about 3% and a moisture content of about 15%, based on the weight of the dry coal.

EXAMPLE 3

The process of Example 1 is repeated using (a) Kittanning seam coal; (b) Illinois #6 seam coal; and (c) lower Freeport seam coal in lieu of the Pittsburg seam coal. A cleaned coal product having an ash content of about 3.0% and a moisture concentration of 15%, based on the weight of the dry coal, is provided.

EXAMPLE 4

200 grams, Illinois #6 coal reduced to about $\frac{1}{4}''$ size lumps and having an ash content of 19.9%, is crushed to a particle size of about 28 mesh and then pulverized to 200 mesh in a laboratory ball mill in the presence of water to form a coal-aqueous liquid slurry. The liquid phase of the slurry contains about 65% water based on the total weight of the slurry.

50 mg. tall oil, 10 gms. of fuel oil, 250 milligrams sodium pryrophosphate, 100 milligrams of cupric nitrate and 1.0 gms. $H_2O_2$ (5% solution in water) are added to the above coal-aqueous slurry at about 30°–40° C. The hydrophobic, surface treated coal phase which ensues is recovered by removing it from the surface of the aqueous phase on which it floats. The aqueous phase contains the hydrophilic ash and is discarded.

Subsequent to several re-dispersions in clean soft water, containing sodium pyrophosphate, at about 30° C., the surface treated coal is recovered. After filtering through a Buchner funnel, the water content of the coal is about 15%. (Conventionally processed coal, i.e., without chemical surface treatment, customarily retains from about 20–50% water when ground to the same mesh size).

The recovered, mechanically dried, treated, beneficiated coal is admixed with 160 grams of fuel oil and an additional 5.0 gms. of tall oil is added thereto. After thorough admixing at 85° C., caustic soda, equivalent to the acid value of the admixture, is added thereto and further admixed therewith. After standing for several months, no settling of the coal-liquid fuel mixture is observed.

EXAMPLE 5

The process of Example 4 is repeated, except that gram equivalent amounts of the following polymerizable monomers are substituted for the tall oil used in Example 4: (a) coker gasoline and (b) oleic acid.

The surface of the pulverized coal is similarly altered to result in strongly hydrophobic coal particles which are processed similar to Example 4. In each case, the same amount of tall oil is admixed with the recovered beneficiated coal, after drying. Acidity is neutralized with caustic and similar coal-oil liquid suspensions are prepared, which all exhibit thixotropic quality depending upon the metal ion selected to displace the sodium ion of the sodium hydroxide originally added. No settling is observed over several weeks observation, independent of the monomer used in the surface treatment reaction.

EXAMPLE 6

The process of Example 4 is repeated except that 2 grams of benzoyl peroxide are used in place of the hydrogen peroxide. Moreover, 2 grams of Triton-X-100 surfactant and 25 grams of sodium pyrophosphate are present in the original slurry water. The ash in the resulting aqueous phase is filtered out after treating with lime. The ash content of the treated coal is reduced from about 19.9% to about 4.7% after five separate washings, wherein the water also contains Triton-X-100 and sodium pyrophosphate. The tall oil used in the surface treatment reaction and the tall oil employed in the formation of the stable coal-oil mixture, is neutralized first with caustic soda and subsequently treated with an equivalent amount of calcium hydroxide. The viscosity of the coal-oil mixture is of a thixotropic gel-like nature, indicating no settling is to be expected upon extended standing.

EXAMPLE 7

235 grams of beneficiated coal having a 15% moisture content prepared in accordance with Example 1 is placed in a vessel in which a stabilized coal-fuel oil mixture is formed by the addition to said coal of 200 gms of #2 fuel oil, 6.0 gms. tall oil, 1.0 gms. of a 0.1% solution of $H_2O_2$ (or benzoyl peroxide) in water (toluene), and 2.0 gms. of a 0.1% aqueous solution of cupric nitrate. The mixture is stirred for about 1.0 minute at about 85° C. 1.5 gms. of sodium hydroxide is added thereto and stirred for 5.0 minutes at about 65° C. The resultant coal-oil mixture is a stabilized gel and remains so indefinitely.

Obviously, other modifications and variations of the present invention are possible in the light of the above teachings. It is, therefore, to be understood that changes may be made in the particular embodiments of this invention which are within the full intended scope of the invention as defined by the appended claims.

What is claimed is:

1. A beneficiated coal product comprising surface treated, hydrophobic and olephilic coal having a reduced ash content within the range of from about 0.5 to about 10% by weight based on the weight of dry coal.

2. The beneficiated coal product of claim 1 also having a reduced sulphur content within the range of from about 0.1 to about 4% weight based on the weight of dry coal.

3. The beneficiated coal product of claim 2 also having a reduced moisture content of from about 2 to about 25% by weight based on the weight of dry coal.

4. A coal slurry comprising a mixture of the beneficiated coal product of claim 1 and a carrier.

5. The coal slurry of claim 4 wherein said carrier is water.

6. A stabilized aqueous coal mixture comprised of an intimite admixture of the beneficiated coal product of claim 1, water and a sufficient amount of an alkali or alkaline earth metal hydroxide or oxide to provide said aqueous coal mixture with a pH of above 7.

7. The stabilized aqueous coal mixture of claim 6 wherein said alkali hydroxide is sodium hydroxide.

* * * * *

UNITED STATES PATENT AND TRADEMARK OFFICE

CERTIFICATE OF CORRECTION

PATENT NO. : 4,526,585

DATED : July 2, 1985

INVENTOR(S) : Burgess et al.

It is certified that error appears in the above-identified patent and that said Letters Patent is hereby corrected as shown below:

Column 2, Line 51, "salt leaching" should read --ferric salt leaching--;

Column 5, Line 39, "ethyacrylate" should read --ethylacrylate--;

Column 7, Line 61, "seperable" should read --separable--;

Column 8, Line 40, "temperatues" should read --temperatures--;

Column 15, Line 6, "cleam" should read --clean--;

UNITED STATES PATENT AND TRADEMARK OFFICE

CERTIFICATE OF CORRECTION

PATENT NO. : 4,526,585

DATED : July 2, 1985

INVENTOR(S) : Burgess et al.

It is certified that error appears in the above-identified patent and that said Letters Patent is hereby corrected as shown below:

Column 15, Lines 7 & 8, "II), having no flowable high energy source for a wide variety of end uses"
should read
--II), having no tendency to settle out, is storably recovered to provide a flowable high energy source for a wide variety of end uses--;

Column 16, Line 19, "pryophosphate" should read --pyrophosphate--;

Column 18, Line 6, "olephilic" should read --oleophilic--;

Column 18,Line 21, "intimite" should read --intimate--.

Signed and Sealed this

Fourth Day of November, 1986

[SEAL]

*Attest:*

DONALD J. QUIGG

*Attesting Officer*

*Commissioner of Patents and Trademarks*